US009225096B2

(12) United States Patent
Crofoot et al.

(10) Patent No.: US 9,225,096 B2
(45) Date of Patent: Dec. 29, 2015

(54) HIGH-VOLTAGE RESISTANCE CABLE TERMINATION

(75) Inventors: Larry Crofoot, Perry, OH (US); John T. Venaleck, Painesville, OH (US)

(73) Assignee: Cardioinsight Technology, Inc., Cleveland, OH (US)

( * ) Notice: Subject to any disclaimer, the term of this patent is extended or adjusted under 35 U.S.C. 154(b) by 88 days.

(21) Appl. No.: 14/115,593

(22) PCT Filed: May 3, 2012

(86) PCT No.: PCT/US2012/036267

§ 371 (c)(1),
(2), (4) Date: Jan. 30, 2014

(87) PCT Pub. No.: WO2012/151368

PCT Pub. Date: Nov. 8, 2012

(65) Prior Publication Data

US 2014/0134893 A1 May 15, 2014

Related U.S. Application Data

(60) Provisional application No. 61/481,851, filed on May 3, 2011.

(51) Int. Cl.
*H01R 4/02* (2006.01)
*H01R 13/405* (2006.01)
(Continued)

(52) U.S. Cl.
CPC ..... *H01R 13/405* (2013.01); *H01R 4/023* (2013.01); *H01R 43/0228* (2013.01); *H01R 9/2416* (2013.01); *H01R 13/53* (2013.01); *H01R 43/0263* (2013.01)

(58) Field of Classification Search
CPC .. H01R 12/592; H01R 2103/00; H01R 43/24; H01R 4/02
USPC ..... 439/494, 499, 597, 599, 604, 606, 736, 439/874
See application file for complete search history.

(56) References Cited

U.S. PATENT DOCUMENTS 4,599,588 A * 7/1986 Bell ..... 335/127
4,767,345 A * 8/1988 Gutter et al. ..... 439/92
(Continued)

FOREIGN PATENT DOCUMENTS

EP 0849834 A2 6/1998
WO WO 2009/132332 A1 10/2009

OTHER PUBLICATIONS

Supplementary European Search Report, CardioInsight Technologies, Inc., Date of Completion: Nov. 6, 2014; 5pp.
(Continued)

*Primary Examiner* — Thanh Tam Le
(74) *Attorney, Agent, or Firm* — Tarolli, Sundheim, Covell & Tummino LLP

(57) ABSTRACT

A linear connector contact array is presented with focus on the tails of the contacts that are connected to individual wires. A wire management comb made from dielectric material positions each wire over its contact's tail. The wire is attached to the tail by electrically welding the wire to the tail without removing the insulating material. This is accomplished with a heated welding electrode that melts through the insulator material until electrical contact is made with the wire. A non-heated electrode is beneath the tail to complete this circuit. The wire management comb has deep channels which form insulating ribs between adjacent wires. The weld sites are staggered, and exposed ends of the contact tails are held short of the end of the management comb.

19 Claims, 4 Drawing Sheets

(51) Int. Cl.

| | |
|---|---|
| ***H01R 43/02*** | (2006.01) |
| *H01R 9/24* | (2006.01) |
| *H01R 13/53* | (2006.01) |

(56) References Cited

U.S. PATENT DOCUMENTS

| | | | | |
|---|---|---|---|---|
| 4,963,699 | A | 10/1990 | Urushibata et al. | |
| 5,308,258 | A * | 5/1994 | Hatsios | 439/284 |
| 5,833,476 | A * | 11/1998 | Sakamaki | 439/164 |
| 5,879,196 | A * | 3/1999 | Lee | 439/660 |
| 5,953,815 | A * | 9/1999 | Kaminski et al. | 29/860 |
| 6,210,204 | B1 | 4/2001 | Ko et al. | |
| 6,232,556 | B1 * | 5/2001 | Daugherty et al. | 174/88 R |
| 6,375,520 | B1 | 4/2002 | Shuey | |
| 6,386,926 | B1 * | 5/2002 | Lee | 439/736 |
| 7,112,087 | B2 * | 9/2006 | Tago et al. | 439/495 |
| 7,462,065 | B1 * | 12/2008 | Zhao | 439/499 |
| 8,052,477 | B1 * | 11/2011 | Ko | 439/660 |
| 8,678,835 | B2 * | 3/2014 | Takahashi et al. | 439/13 |
| 8,721,361 | B2 * | 5/2014 | Wu | 439/497 |
| 8,888,518 | B2 * | 11/2014 | Takahashi et al. | 439/164 |
| 2002/0039848 | A1 | 4/2002 | Chiang | |
| 2003/0139082 | A1 | 7/2003 | Aramoto et al. | |
| 2004/0092164 | A1 | 5/2004 | Lee | |
| 2005/0014418 | A1 | 1/2005 | Ji | |
| 2005/0032413 | A1 | 2/2005 | Tolmie | |

OTHER PUBLICATIONS

PCT Int'l Search Report and Written Opinion—8 pgs., Nov. 23, 2012, CardioInsight Technologies, Inc.

* cited by examiner

HIGH-VOLTAGE RESISTANCE CABLE TERMINATION

This application is a U.S. National Stage Application filed under 35 U.S.C. §371 of PCT/US2012/036267, having a filing date of May 5, 2012, which claims the benefit of U.S. Provisional Patent Application No. 61/481,851, filed on May 3, 2011, and entitled HIGH-VOLTAGE RESISTANCE CABLE TERMINATION. The entire contents of each of the above-identified patent applications are incorporated herein by reference.

BACKGROUND

In the electrical field, especially in the electronics field, it is common to manufacture electrical cable assemblies having a multiplicity of insulated wires attached to a single electrical connector having an array of electrical contacts. Typically, the insulated wires are stripped of the insulating material a small distance from the end of the wires, and a contact is crimped, soldered, or welded to the end of the wire. These contacts are then inserted into a connector body forming the array aforementioned.

SUMMARY OF THE INVENTION

A wire management comb is presented wherein insulated electrical wire is attached to an electrical contact array such that very high voltage can exist between adjacent wires without voltage breakdown or leakage. The ability of these connections to sustain a voltage between adjacent contacts depends largely upon the distance between them, the shortest path along any joining surface being the important consideration. In the electronics field, these distances can be very small such that voltages of as little as 100VDC can cause deleterious leakage. A configuration that will allow voltage of 5000VDC between adjacent wires and these contacts would be desirable.

According to one aspect of the invention, the tails of a contact array are positioned in slots of an insulated management comb. The slots are deep enough to provide distance from one tail to its nearest neighbor along the surface of the insulation greater than the direct distance between them.

According to another aspect of the invention, weld locations are provided in staggered array such that the distance along the surface of the management combs from one weld site to its nearest neighbor is larger than the distance between contacts.

According to yet another aspect of the invention, the tails of the contacts stop short of the end of the management combs such that the distance allowing the surface of the combs from one contact end to its nearest neighbor is larger than the distance between contacts.

According to still another aspect of the invention, the wires are welded without removing the insulation by utilizing a heated electrode that melts through the insulation to contact the electrical conductor. This site and the end of the insulated wire constitute the only exposed conductor. These sites are isolated by the configuration of the management comb.

According to a further aspect of the invention an electrical connector includes: an array of contacts; and a header that holds the contacts in position relative to one another; wherein the connector may include one or more of the following: the header is made of plastic; the header is molded around the contacts; the header includes a comb that supports contact tails of the contacts; the contact tails are in slots of the comb; the slots have open spaces adjacent to a back face of the header, that the contact tails do not extend into; the slots have widened portions that allow insertion of an electrode for electrically welding conductors to the contact tails; the widened portions are staggered, at different distances from the back face of the header; the widened portions alternate being relatively close to the back face, and relatively far from the back face; the comb has bottom holes at locations corresponding to the locations of the widened portions; the bottom holes are configured to allow insertion of an electrode for welding; and the bottom holes allow access to undersides of the contact tails.

According to a still further aspect of the invention, a method of securing wires to contact tails of contacts includes: placing the wires in slots in a dielectric material comb, wherein the contact tails are in the slots; and electrically welding conductors of the wires to the contact tails, within the slots; wherein the method may include one or more of the following: inserting a first welding electrode into widened portions of the slots; the widened portions are located at different distances relative to a back face of the comb; the first electrode is a heated electrode; insulation of the wires in the vicinity of the widened portions, is thereby melted with the heated electrode, exposing portions of the conductors of the wires; inserting a second electrode into bottom holes of the comb that correspond in location to the widened portions; the second electrode is an unheated electrode; the unheated electrode contacts a metal surface of a contact tail to be welded; and the welding includes welding the exposed portions of the conductors to the contact tails using the electrodes.

According to another aspect of the invention, an electrical connector includes: an array of contacts; and a header that holds the contacts in position relative to one another. The header includes a comb that supports contact tails of the contacts. The contact tails are in slots of the comb.

According to yet another aspect of the invention, a method of securing wires to contact tails of contacts includes: placing the wires in slots in a dielectric material comb, wherein the contact tails are in the slots; and welding conductors of the wires to the contact tails, within the slots.

To the accomplishment of the foregoing and related ends, the invention comprises the features hereinafter fully described and particularly pointed out in the claims. The following description and the annexed drawings set forth in detail certain illustrative embodiments of the invention. These embodiments are indicative, however, of but a few of the various ways in which the principles of the invention may be employed. Other objects, advantages and novel features of the invention will become apparent from the following detailed description of the invention when considered in conjunction with the drawings.

BRIEF DESCRIPTION OF THE DRAWINGS

The annexed drawings, which are not necessarily to scale, show various features of the invention.

FIG. 3 is another plan view of the electrical connector part of FIG. 1.

DETAILED DESCRIPTION

A linear connector contact array is presented with focus on the tails of the contacts that are connected to individual wires. A wire management comb made from dielectric material positions each wire over its contact's tail. The wire is attached to the tail by electrically welding the wire to the tail without removing the insulating material. This is accomplished with a heated welding electrode that melts through the insulator material until electrical contact is made with the wire. A non-heated electrode is beneath the tail to complete this circuit. The wire management comb has deep channels into which each wire resides. These channels form insulating ribs between adjacent wires such that the path along the surface of the management comb from one wire to its closest neighbor is very much larger than the distances between wires. Also, the weld sites are staggered such that the distance between weld sites is larger than the distance between wires. Finally, the exposed ends of the contact tails are held short of the end of the management comb such that the path along the surface of the comb from the end of one contact to its nearest neighbor is much longer than the distance between adjacent wires.

As a result of these extended paths, a much larger voltage can be supported between adjacent contacts and wires. To support 5000VDC, a path of approximately 4 mm is required, whereas typical distances between adjacent contacts might be as small as 1 mm. By the methods outlined above, the size of a connector requiring high-voltage isolation can be considerably reduced.

Figure 1:
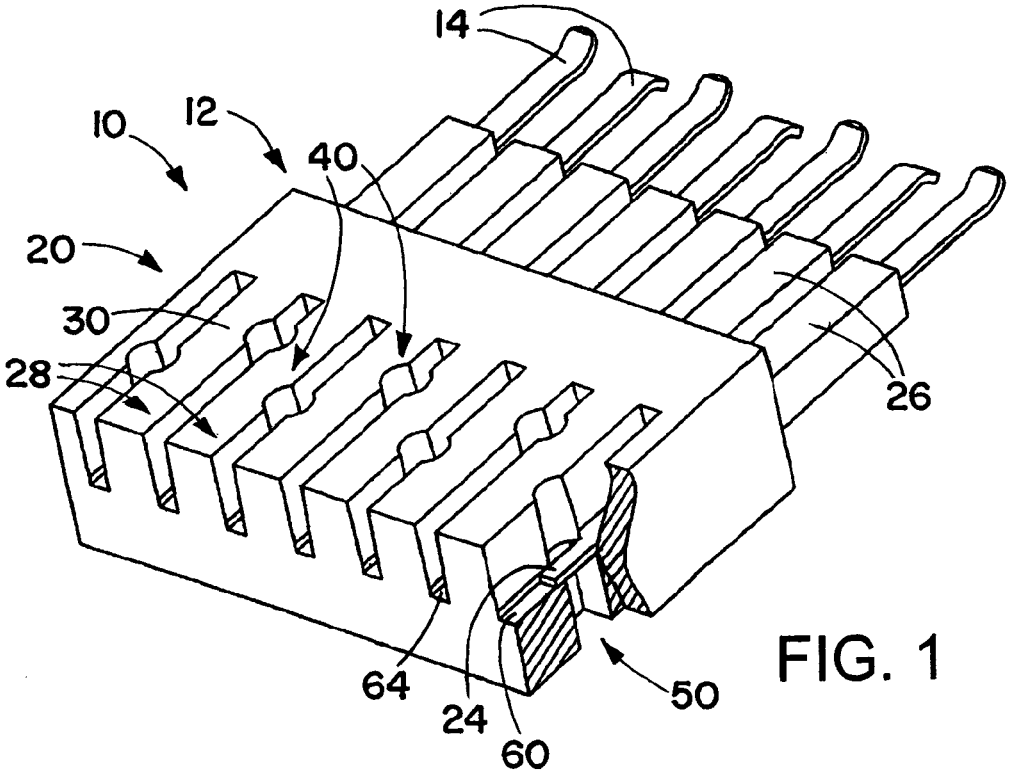
FIG. 1 is an oblique view of an electrical connector part in accordance with an embodiment of the invention.

FIG. 1 shows a connector part 10 that includes a dielectric material header 12 that is used for holding an array of contacts 14. The connector that includes the connector part 10 may have other parts, such as a housing (not shown). The contacts 14 are used to make electrical connection with corresponding contacts (not shown) in a mating connector (not shown). The contacts 14 are made of a suitable electrically conductive material, for example copper. The contacts 14 in the illustrated embodiment are hermaphroditic contacts, but the contacts 14 alternatively may have any of a variety of other configurations.

The header 12 is a single molded plastic piece that includes a comb 20 that is used for managing electrical connections between wires (not shown in FIG. 1) and tails 24 of the contacts 14. The header 12 may also include other parts, such as posts 26 surrounding parts of individual of the contacts 14.

Figure 2:
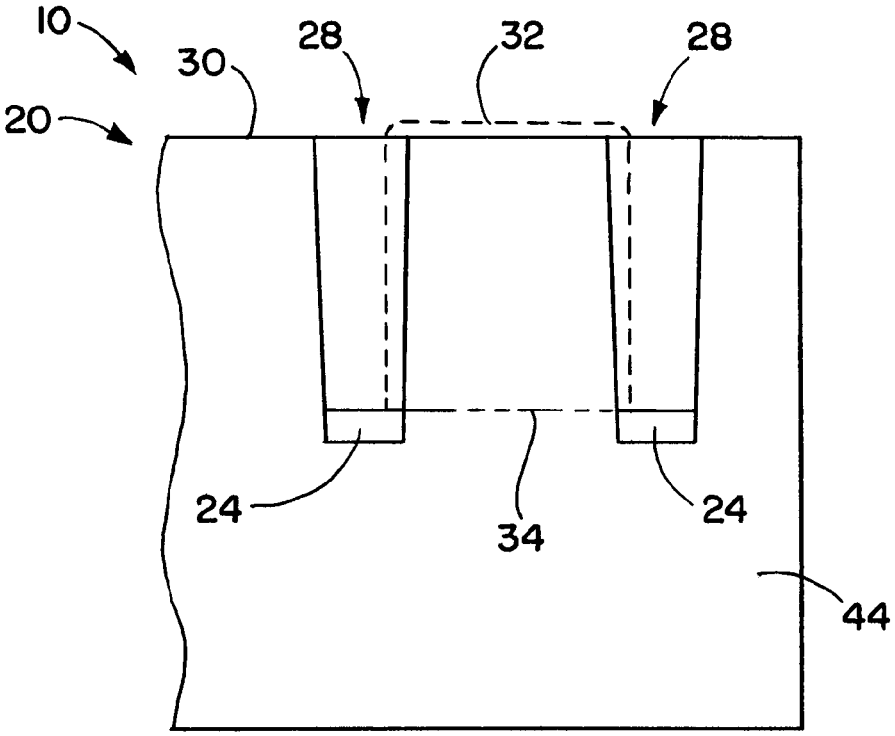
FIG. 2 is a cross-sectional view of part of the electrical connector part of FIG. 1.

The comb 20 has a series of slots 28 in its top surface 30 that allow wires to be placed therein to make contact with the tails 24. The slots 28 are deep enough to provide enhanced electrical isolation between adjacent of the contact tails 24. This is illustrated in FIG. 2, which shows a back view of the connector part 10. An electrical isolation path 32 between adjacent of the contact tails 24, around the dielectric material of the comb 20, is much longer than a direct spacing 34 between the contact tails 24. The intervening dielectric material of the comb 20 greatly increases the electrical isolation of the contact tails 24 from one another. This helps prevent current leakage or voltage breakdown between the contact tails 24.

Figure 3:
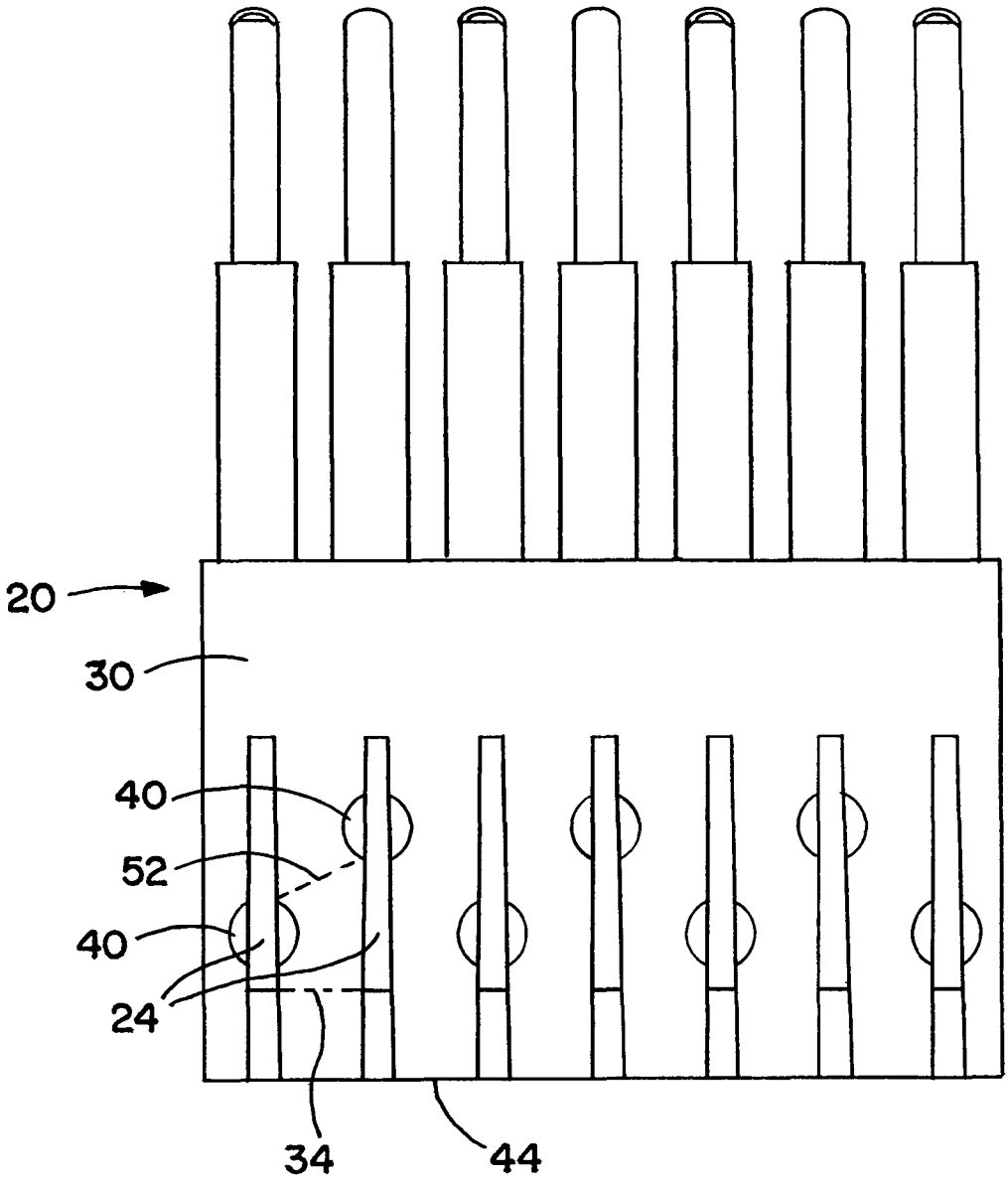
FIG. 3 is a plan view of the electrical connector part of FIG. 1.

As also shown in FIG. 3, the slots 28 have respective widened portions 40 which are weld locators, used for indicating the locations where inserted wires are to be welded to the contact tails 24. The widened portions 40 are staggered, having different distances from a back face 44 of the comb 20. The widened portions 40 are at two distances from the back face 44, alternating between ones relatively close to the back face 44, and ones relatively far from the back face 44. The comb 20 also includes bottom holes 50 that allow access from the bottom of the header 12, at locations corresponding to those of the slot widened portions 40, for welding wires to the contact tails 24. The bottom holes 50 allow access to undersides of the contact tails 24.

The staggered locations for the widened portions 40 aid in electrically isolating the contact tails 24 from one another. An electrical isolation path 52 from the widened portions 40 of adjacent of the contact tails 24 is longer than the direct spacing 34 between the contact tails 24. Due to the staggering of the widened portions 40, the omission of dielectric material for the widened portions 40 does not result in a shorter electrical path between adjacent of the widened portions 40. The path 52 may be about the same length as the path 32 (FIG. 2).

Figure 4:
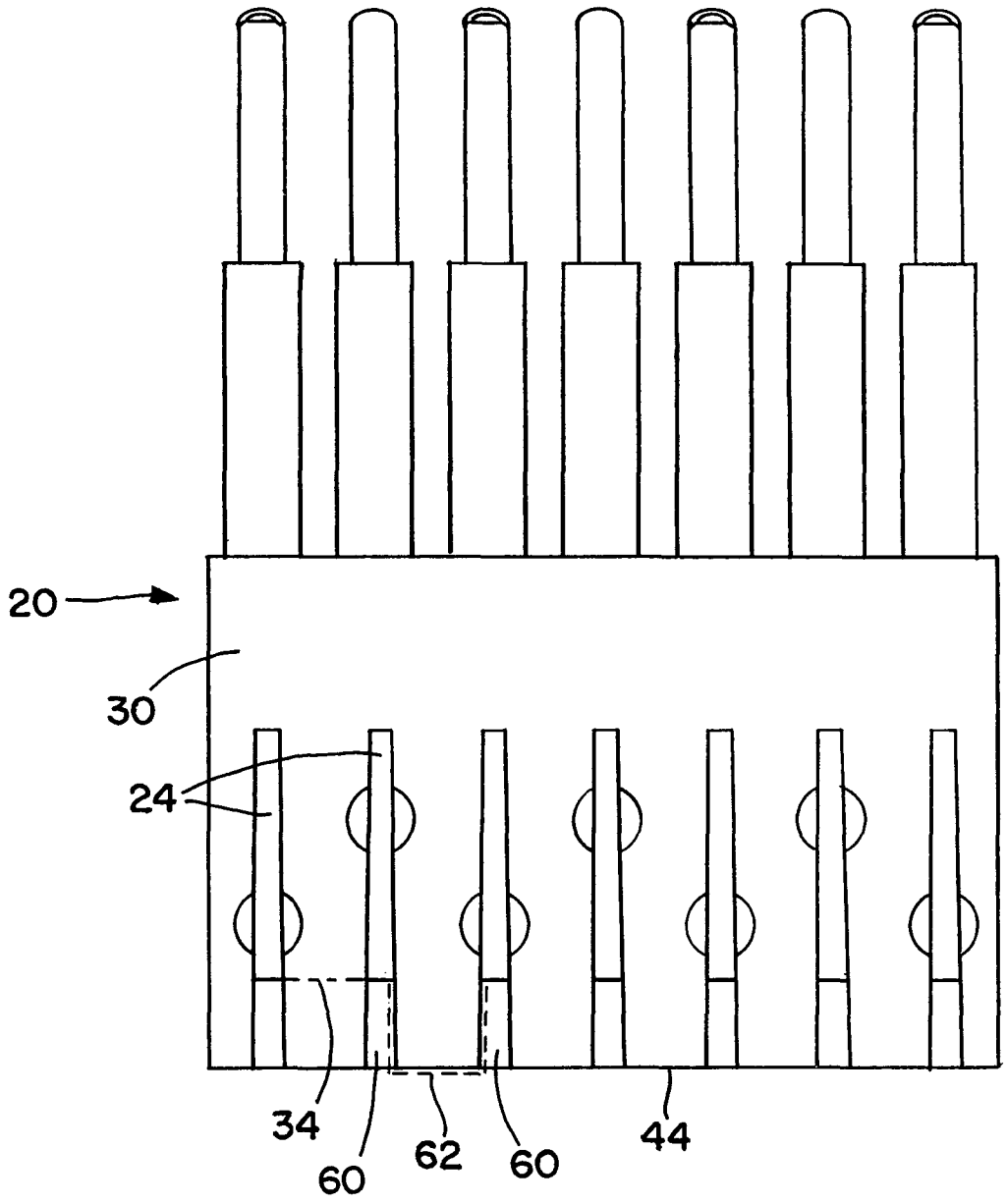

FIG. 4 shows how the tails 24 stop well short of the back face 44 of the comb 20, leaving open spaces 60 at the ends of the slots 28, with no conductive material in them. This arrangement makes for an electrical isolation path 62 around the back face 44, between adjacent of the contact tails 24, that is longer than the direct spacing 34 between the contact tails 24. The path 62 may be about the same length as the path 32 (FIG. 2) and/or the path 52 (FIG. 3). Alternatively the paths 32, 52, and 62 may all have different lengths.

Figure 5:
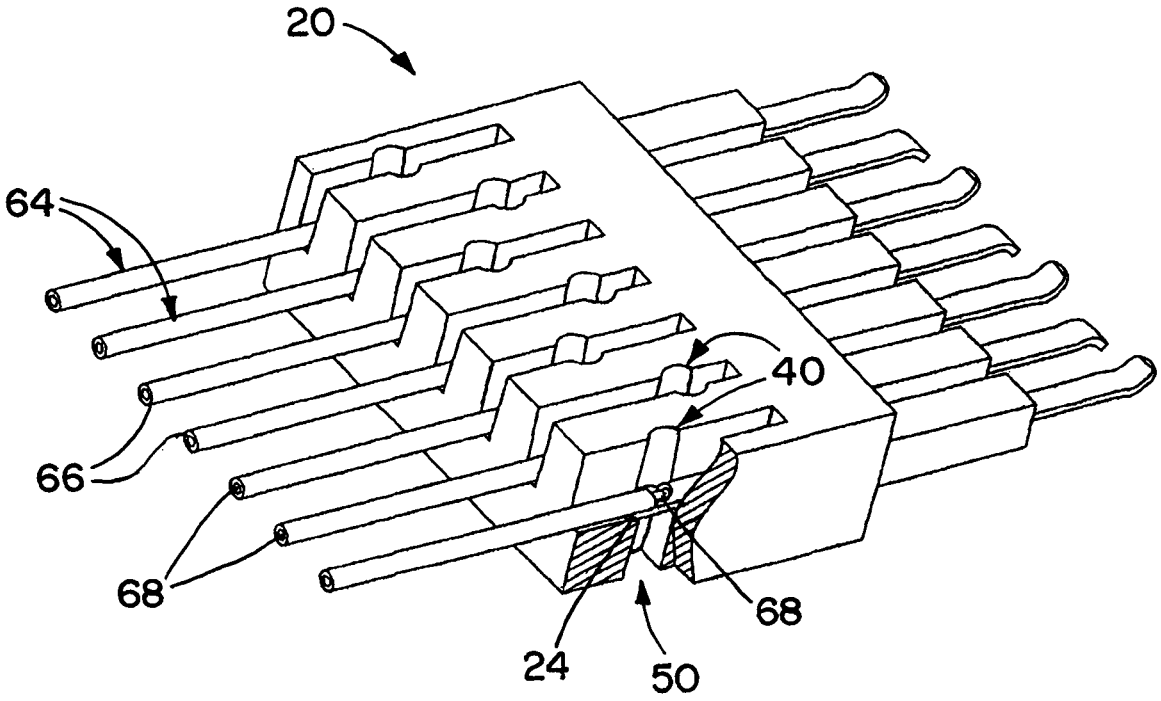
FIG. 5 is an oblique, partially fragmented view of the electrical connector part of FIG. 1, with wire coupled to contact tails of the electrical connector part.

FIG. 5 shows wires 64 welded to the contact tails 24. The wires 64 may be welded to the contact tails 24 without removing the insulation 66 by utilizing a heated electrode (not shown) that is inserted down the widened portions 40. The heated electrode melts through the insulation 66 to contact the electrical conductor 68 that runs through the center of the wire 64. This site and the end of the insulated wire 64 constitute the only exposed parts of conductor 68. These sites are isolated by the configuration of the management comb 20. An additional electrode (not shown) is inserted through the bottom hole 50. The additional electrode is an unheated electrode that cooperates with the heated electrode to weld the electrical conductor 68 to the contact tail 24.

The configuration of the comb 20 provides good electrical isolation between the contact tails 24. The isolation paths 32, 52, and 62 are all significantly longer than the direct spacing 34 between the contact tails 24. These long isolation paths reduce the risk of current leakage and voltage breakdown.

Many variants are possible regarding the above device and method. For example the comb of the header may include any suitable number of contacts. Also, other configurations may be used in coupling wires to contacts.

Although the invention has been shown and described with respect to a certain preferred embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

What is claimed is:

1. An electrical connector comprising:

an array of contacts; and a header that holds the array of contacts in position relative to one another, the header comprising a comb with slots that support contact tails of the array of contacts therein, wherein a top face of the slots have widened portions that are staggered at different distances from a back face of the header and corresponding widened portions on a bottom face of the slots.

2. The electrical connector of claim 1, wherein the header is made of plastic.

3. The electrical connector of claim 1, wherein the header is molded around the array of contacts.

4. The electrical connector of claim 1, wherein the slots have open spaces adjacent to the back face of the header, that the contact tails do not extend into.

5. The electrical connector of claim 1, wherein the widened portions of the slots allow insertion of electrodes for welding conductors to the contact tails.

6. The electrical connector of claim 5, wherein the widened portions alternate being relatively close to the back face, and relatively far from the back face.

7. The electrical connector of claim 1, wherein the corresponding widened portions on the bottom face of the slots are configured to allow insertion of an electrode for welding.

8. The electrical connector of claim 1, wherein the corresponding widened portions on the bottom face of the slots allow access to undersides of the contact tails.

9. The electrical connector of claim 1, wherein the array of contacts are an array of hermaphroditic contacts.

10. The electrical connector of claim 1, wherein the header holds respective portions of the array of contacts in position relative to one another such that remaining portions of the array of contacts protrudes from the header;

wherein respective parts of the remaining portions of the array of contacts protruding from the header are enclosed by material to form posts; and wherein the header and the posts form a single molded plastic piece.

11. A method of securing wires to contact tails of contacts, the method comprising:

placing conductors of the wires in slots in a dielectric material comb comprising the contact tails, wherein a top face of the slots have widened portions that are staggered at different distances from a back face of the dielectric material comb and corresponding widened portions on a bottom face of the slots; and welding the conductors of the wires to the contact tails.

12. The method of claim 11, wherein the welding includes inserting a first welding electrode into the widened portions of the top face of the slots.

13. The method of claim 12, wherein the first electrode is a heated electrode; and wherein the welding includes heating the first electrode.

14. The method of claim 13, further comprising removing insulation of the wires in the vicinity of the widened portions of the top face of the slots, by melting the insulation with the heated electrode, to thereby expose the conductors of the wires.

15. The method of claim 14, wherein insulation of the wires in the vicinity of the widened portions of the top face of the slots, is melted with the heated electrode, exposing the conductors of the wires.

16. The method claim 12, wherein the welding further includes inserting a second electrode into the widened portions of the bottom face of the slots.

17. The method of claim 16, wherein the second electrode is an unheated electrode.

18. The method of claim 17, wherein the welding includes the unheated electrode contacting a metal surface of a contact tail to be welded.

19. The method of claim 17, wherein the welding includes welding the the conductors of the wires to the contact tails using the electrodes.

* * * * *